US011817074B2

(12) United States Patent
McCaslin

(10) Patent No.: US 11,817,074 B2
(45) Date of Patent: Nov. 14, 2023

(54) AIRGUN SOUND MODERATOR WITH POLYMERIC ACOUSTIC BAFFLES

(71) Applicant: John A. McCaslin, Alvarado, TX (US)

(72) Inventor: John A. McCaslin, Alvarado, TX (US)

( * ) Notice: Subject to any disclaimer, the term of this patent is extended or adjusted under 35 U.S.C. 154(b) by 251 days.

(21) Appl. No.: 17/343,224

(22) Filed: Jun. 9, 2021

(65) Prior Publication Data

US 2022/0399001 A1 Dec. 15, 2022

(51) Int. Cl.
*G10K 11/162* (2006.01)
*F41B 11/70* (2013.01)

(52) U.S. Cl.
CPC ..... *G10K 11/162* (2013.01); *F41B 11/70* (2013.01)

(58) Field of Classification Search
CPC ..... F41B 11/70; G10K 11/162
See application file for complete search history.

(56) References Cited

U.S. PATENT DOCUMENTS

| | | | | |
|---|---|---|---|---|
| 1,127,250 | A | 2/1915 | Humm | |
| 2,073,951 | A | 3/1936 | Servais | |
| 2,043,731 | A | 6/1936 | Bourne | |
| 2,442,773 | A | 6/1948 | Mason | |
| 2,448,382 | A | 8/1948 | Mason | |
| 3,713,362 | A * | 1/1973 | Charron | F41A 21/30 89/14.4 |
| 4,530,417 | A | 7/1985 | Daniel | |
| 5,136,923 | A | 8/1992 | Walsh, Jr. | |
| 6,109,387 | A * | 8/2000 | Boretti | F01N 1/082 181/258 |
| 6,298,764 | B1 | 10/2001 | Sherman et al. | |
| 8,196,701 | B1 | 6/2012 | Oliver | |
| 9,546,838 | B2 | 10/2017 | Iskey et al. | |
| 10,234,228 | B2 | 3/2019 | Person | |
| 10,458,737 | B2 * | 10/2019 | Schwartzkopf | B22F 5/00 |
| 11,435,156 | B1 * | 9/2022 | Dellinger | G10K 11/165 |
| 11,512,917 | B2 * | 11/2022 | Turnblom | F41A 21/36 |
| 2003/0145718 | A1 * | 8/2003 | Hausken | F41A 21/30 89/14.4 |
| 2016/0298459 | A1 * | 10/2016 | Bryant | F01D 5/34 |
| 2019/0135200 | A1 * | 5/2019 | Kato | B60N 3/042 |
| 2019/0376758 | A1 * | 12/2019 | Tiziani | F41A 21/34 |
| 2023/0014337 | A1 * | 1/2023 | Schlosser | F41A 21/04 |

* cited by examiner

*Primary Examiner* — Forrest M Phillips
(74) *Attorney, Agent, or Firm* — Dan Brown Law Office; Daniel R. Brown

(57) ABSTRACT

An airgun moderator employing a stack of acoustic baffles fabricated from fibrous polymeric felt, which degrades in the presence of gunpowder combustion temperatures, thereby providing an effective airgun sound moderator that us ineffective as a firearms silencer.

22 Claims, 3 Drawing Sheets

2

4

AIRGUN SOUND MODERATOR WITH POLYMERIC ACOUSTIC BAFFLES

RELATED APPLICATIONS

None.

BACKGROUND OF THE INVENTION

Field of the Invention

The present invention relates to sound moderators for airguns. More particularly, the present disclosure relates to airgun sound moderators that employ a stack of acoustic baffles made from fibrous polymeric felt, which rapidly deteriorate in the presences of gunpowder combustion products and temperatures, thereby reducing their potential effectiveness for suppression of firearms.

Description of the Related Art

In the field of firearms, given the high impulse sound pressure levels generated during firearm discharge, the use of sound suppressors, or "silencers", is well known. Gunpowder combustion products, discharged gases, high temperatures, and the fired bullet all contribute to the generation of this impulse. Firearm silencers greatly reduce the peak sound pressure levels in firearms. Certain combinations of firearm caliber and silencer can reduce the acoustic impulse to such a low level that the need for hearing protection is obviated. Pneumatic airguns also produce significantly high acoustic impulses upon discharge. This is particularly true in the case of pre-charged pneumatic ("PCP") airguns, in both rifles and pistol configurations. PCP airguns commonly operate with up to 4,500 PSI air pressure, which result in acoustic impulse levels that are potentially not "hearing-safe", so the use of hearing protection is recommended. "Sound moderators" are known, and are employed to reduce the acoustic impulse to hearing-safe levels.

The use of firearm silencers on airguns can be effective in reducing the airgun acoustic impulse to hearing-safe levels. However, firearm silencers are subject to tight control under state and federal law, and are subject to criminal penalties if such laws are violated. According to the Gun Control Act Definitions on silencers (18 U.S.C., § 921(A) (24)), the term "Firearm Silencer" or "Firearm Muffler" means any device for silencing, muffling, or diminishing the report of a portable firearm, including any combination of parts, designed or redesigned, and intended for the use in assembling or fabricating a firearm silencer or firearm muffler, any part intended only for use in such assembly or fabrication. Furthermore, any device that meets the definition as stipulated above in 18 U.S.C. § 921(a)(24) is also subject to controls of the National Firearms Act 26 U.S.C., Chapter 53 ("NFA"). Thus, the lawful use of a firearm silencer is subject to the NFA, including criminal background checks for any purchaser, payment of a substantial tax, extended waiting periods for approval, as well as a wide range of state laws and regulations. The NFA does not cover airguns or airgun sound moderators. For these reasons, the use of firearm silencers on airguns is not a favorable option.

In the case of products designed to be used for sound moderation in airguns, there is a legitimate legal concern about their potential use on firearms. In the case where the transfer or use between airguns and firearms exists, then interpretation the NFA language becomes critical to providers and users alike, as it may be a criminal act to make, sell, transfer or use an airgun moderator on a firearm. Airgun moderator providers have striven to produce airgun moderators that cannot easily be used on firearms, to avoid such legal liability. This often manifests itself as an incompatibility in the means for connecting the airgun moderator to a firearm. However incompatible the designs may be, the ability to conceive of and produce some sort of adapter always clouds the legal questions at issue. Thus is can be appreciated that there is a need in the art to address the forging problems in the prior art.

SUMMARY OF THE INVENTION

The need in the art is addressed by the apparatuses and methods of the present invention. The present disclosure teaches an airgun sound moderator assembly for attachment to an airgun that has a barrel defining a bore axis, where the barrel is fixed to a frame member, and that has a moderator engagement fitting adjacent a muzzle end thereof. The assembly includes an elongated housing that has an interior profile, and that has an airgun engagement fitting at a first end, and that has a moderator muzzle cap at a second end, and wherein the airgun engagement fitting is selectively attachable to the airgun moderator engagement fitting. A stack of plural acoustic baffles are located within the elongated housing between the airgun engagement fitting and the moderator muzzle cap. The plural acoustic baffles are each fabricated from a fibrous polymer felt, which inherently defines a polymer softening temperature and a polymer melting temperature, where the specific polymer is selected to provide sufficient rigidity of the felt to maintain structural shape below the polymer softening temperature, and where the polymer softening temperature and the polymer melting temperature are both less than three hundred degrees celsius, such that the plural acoustic baffles will rapidly deteriorate if exposed to gunpowder combustion products and temperatures. Each of the plural acoustic baffles are substantially planar, and have a thickness in the range of 0.5 to 4.0 centimeters, with an outer profile that at least partially conforms with the interior profile of the elongated housing, and each have a bore hole formed therethrough, which is aligned with the bore axis when the airgun engagement fitting is engaged with the moderator engagement fitting.

In a specific embodiment of the foregoing assembly, the fibrous polymer felt is fabricated from polyethylene terephthalate fibers. In a refinement to this embodiment, the polyethylene terephthalate fibers are substantially heterogeneous in size, and the plural acoustic baffles are thermally cut from sheet felt material, which partially fuses the cut edges to enhance rigidity.

In a specific embodiment of the foregoing assembly, where the moderator engagement fitting is fixed to the airgun frame and internally threaded, the airgun engagement fitting is externally threaded for selective attachment to the moderator engagement fitting.

In a specific embodiment of the foregoing assembly, where the airguns discharges a projectile of predetermine caliber, the plural acoustic baffles includes a first portion of baffles interleaved with a second portion of baffles, and the first portion of baffles have round boreholes with a first diameter that is larger than the predetermined caliber, and the second portion of baffles have a second bore hole size that is larger than the first diameter.

In a specific embodiment to the foregoing assembly, the second bore hole size is cut to reveal a zigzag edge profile. In another specific embodiment, the second bore hole size is cut to reveal an undulating edge profile. In another specific embodiment to the foregoing assembly, a portion of the plural acoustic baffles are cut such that the outer profile reveals a concave scalloped edge. In another specific embodiment of the foregoing assembly, a portion of the plural acoustic baffles are cut such that the outer profile reveals a castellated edge.

The present disclosure teaches an airgun sound moderator assembly for insertion into an airgun that has a barrel that defines a bore axis, where the barrel located within a frame member by a barrel support member, and where the frame member has an interior profile and is enclosed at a muzzle end by a muzzle cap. The assembly includes a stack of plural acoustic baffles that can be located within the frame between the barrel support member and the muzzle cap. The plural acoustic baffles are each fabricated from a fibrous polymer felt, which inherently defines a polymer softening temperature and a polymer melting temperature, and, the polymer is selected to provide sufficient rigidity of the felt to maintain its structural shape below the polymer softening temperature, and where the polymer softening temperature and the polymer melting temperature are both less than three hundred degrees celsius. This assures that the plural acoustic baffles will rapidly deteriorate if exposed to gunpowder combustion products and temperatures. Each of the plural acoustic baffles are substantially planar and have a thickness in the range of 0.5 to 4.0 centimeters, with an outer profile that at least partially conforms with the interior profile of the frame member, and each has a bore hole formed therethrough, which is aligned with the bore axis when inserted into the airgun frame.

In a specific embodiment, the foregoing assembly further includes a baffle spacer located between the barrel support member and the stack of plural acoustic baffles to provide separation between the barrel and the stack of plural acoustic baffles.

In a specific embodiment of the foregoing assembly, the fibrous polymer felt is fabricated from polyethylene terephthalate fibers. In a refinement to this embodiment, the polyethylene terephthalate fibers are substantially heterogeneous in size, and the plural acoustic baffles are thermally cut from sheet felt material, which partially fuses the cut edges to enhance rigidity.

In a specific embodiment of the foregoing assembly, where the airgun discharges a projectile of predetermine caliber, the plural acoustic baffles include a first portion of baffles interleaved with a second portion of baffles. The first portion of baffles have round boreholes with a first diameter that is larger than the predetermined caliber, and the second portion of baffles have a second bore hole size that is larger than the first diameter. In a refinement to this embodiment, the second bore hole size is cut to reveal a zigzag edge profile. In another refinement to this embodiment, the second bore hole size is cut to reveal an undulating edge profile.

In a specific embodiment of the foregoing assembly, a portion of the plural acoustic baffles are cut such that the outer profile reveals a concave scalloped edge. In another specific embodiment, a portion of the plural acoustic baffles are cut such that the outer profile reveals a castellated edge.

The present disclosure teaches a method of fabricating an airgun moderator assembly, including a stack of plural acoustic baffles, which are for insertion into an airgun or into a separate moderator elongated house that is attached to an airgun. In the case of a separate housing, the airgun has a barrel fixed to a frame member that defines a bore axis, and has a moderator engagement fitting adjacent to its muzzle end, for attachment of an elongated housing that has an interior profile, and that has an airgun engagement fitting at a first end, and a moderator muzzle cap at a second end, and where the airgun engagement fitting is selectively attachable to the airgun moderator engagement fitting. In the case of an integrally located moderator assembly, for insertion of the plural acoustic baffles into an airgun that has a barrel located within a frame member by a barrel support member, and where the frame member has an interior profile and is enclosed at a muzzle end by a muzzle cap, which enables location of the stack of plural acoustic baffles within the frame member between the barrel support member and the muzzle cap. In either case, the method includes selecting a substantially planar sheet of fibrous polymer felt within the thickness range of 0.5 to 4.0 centimeters according to its inherent polymer softening temperature and polymer melting temperature, which are both less then three hundred degrees celsius. As such, the polymer will rapidly deteriorate if exposed to gunpowder combustion products and temperatures. The fibrous polymer felt is also selected according to its rigidity, which provides structural strength below the polymer softening temperature. The method further includes cutting the plural acoustic baffles from the sheet of fibrous polymer felt, such that each of the plural acoustic baffles have an outer profile that at least partially conforms with the interior profile of the elongated housing or the interior profile of the frame member, and each has a bore hole formed therethrough, which is located to align with the bore axis of the airgun. This arrangement moderates the acoustic impulse emitted by the airgun upon discharge of a projectile.

In a specific embodiment of the foregoing method, the fibrous polymer felt is fabricated from polyethylene terephthalate fibers. In a refinement to this embodiment, where the polyethylene terephthalate fibers are substantially heterogeneous in size, the method fourth includes thermally cutting the plural acoustic baffles from sheet of polymer felt, thereby fusing the cut edges and enhancing rigidity. In a refinement to this embodiment, where the airgun discharges a projectile of predetermine caliber, the cutting step further includes cutting a first portion of the plural acoustic baffles and cutting a second portion of the plural acoustic baffles, and interleaving the first portion and second portion of the plural acoustic baffles. The first portion of baffles are cut with round boreholes having a first diameter that is larger than the predetermined caliber, and the second portion of baffles are cut with a second bore hole size that is greater than the first diameter.

DESCRIPTION OF THE INVENTION

Figure 1:
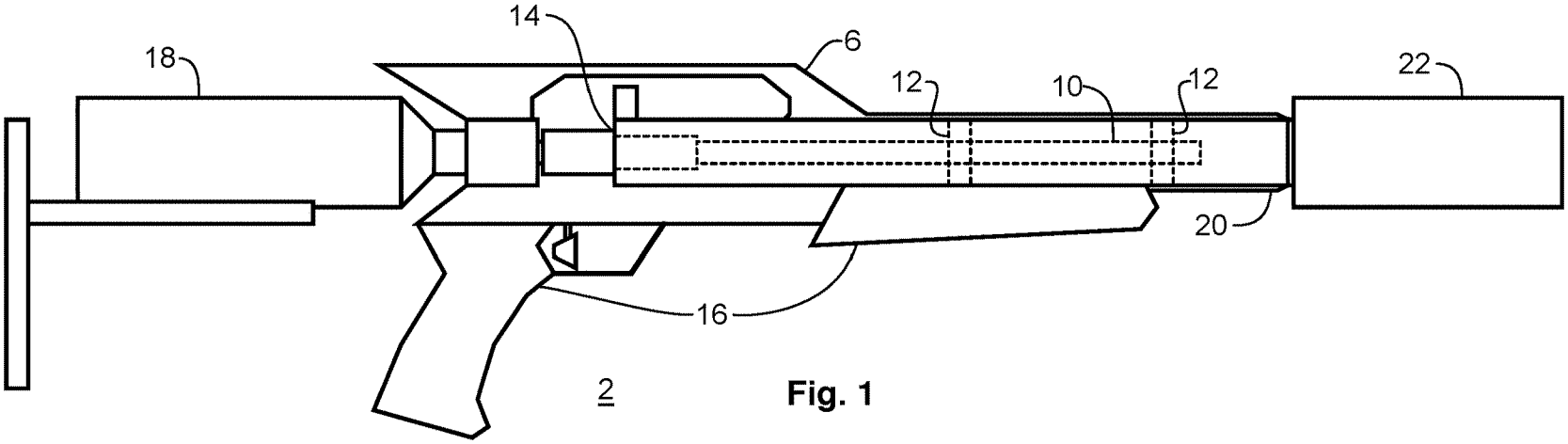
FIG. 1 is a side view drawing of an airgun with a detachable sound moderator according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof, and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and method steps, have been represented where appropriate by conventional symbols in the drawings, showing only those specific details that are pertinent to understanding the present teachings so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present disclosure advantageously teaches assemblies and methods for employing fibrous polymeric felt in the form of a stack of acoustic baffles for both detachable and integral airgun sound moderators. Suitable materials are presented that provide sufficient strength and rigidity to maintain shape and acoustic performance when exposed to repeated compressed air muzzle blast from an airgun, yet, which will quickly deteriorate if exposed to the temperatures and combustion products of gunpowder firearms. In addition to the use of polymeric felt itself, the present disclosures teaches methods of cutting acoustic baffles from sheet polymeric felt material using thermal cutting techniques, including laser cutting, which effectively fuses the fibers exposed along the cutting lines. This technique further reinforces the strength and structure of the polymeric felt acoustic baffles.

As a point of reference, gunpowder typically has a burn temperature of at least 700° C., with maximum temperatures typically exceeding 1400° C. Thus, a firearms silencer must be fabricated from materials that endure such temperatures, and pressures for that matter, for a reasonably large number of repeated exposures in order to be regarded as an effective silencer for firearms applications. In fact, most quality firearms silencers employ a first internal baffle, often referred to as a "blast shield", that is fabricated from a material and shape (thickness) that is particularly effective at enduring such exposure. Synthetic polymers, on the other hand, have considerably lower softening and melting temperatures. So much so, that most will melt or be destroyed when exposed to gunpowder combustion products, temperatures, and pressures.

The list of synthetic polymers (and their respective melting temperatures), roughly in the order of those most often utilized, includes polyethylene (115-135° C.), polypropylene (130-171° C.), polystyrene (240° C.), polyvinyl chloride (100-260° C.), phenol formaldehyde resin (220° C., decomposition), nylon (190-350° C.), polyacrylonitrile (300° C.), silicone (250° C., decomposition), and others. In addition to the melting or decomposition temperatures of such polymers, it is also necessary to consider the rigidity and strength of such materials, as well as available techniques for implementing an acoustic baffles from the materials. For example, synthetic rubbers and silicones are soft and flexible, making them largely unsuitable for airgun sound moderator applications. With respect to the physical structure of polymeric acoustic baffles, felt has been tested and determined to be an effective option for implementation of airgun sound moderator baffles.

Felt is a textile material that is produced by matting, condensing and pressing fibers together. Felt is often referred to as a non-woven fabric, where the fibers engage with one-another through the process of entanglement. Felt can be made of natural fibers, or from synthetic fibers such as petroleum-based polymeric fibers. Felt dampens vibration and absorbs sound, hence its suitability for use as an acoustic baffle in an airgun sound moderator. Testing by the inventors of the present disclosure has established that polymers in the polyester category provide sufficient rigidity and strength to effectively endure applications as acoustic baffles in airgun sound moderators.

Polyester is a category of polymers that contain the ester functional group in every repeat unit of their main chain. As a specific material, it most commonly refers to a type called polyethylene terephthalate (PET). PETs have low less fire-resistant and can melt when ignited. Polyethylene terephthalate is a strong, stiff synthetic material that can be spun into fibers for various applications. PET is produced by the polymerization of ethylene glycol and terephthalic acid. Ethylene glycol is a colorless liquid obtained from ethylene, and terephthalic acid is a crystalline solid obtained from xylene. When heated together under the influence of chemical catalysts, ethylene glycol and terephthalic acid produce PET in the form of a molten, viscous mass that can be spun directly to fibers Under the influence of heat and catalysts, hydroxyl and carboxyl groups react to form ester (CO—O) groups, which serve as the chemical links joining multiple PET units together into long-chain polymers. The presence of a large aromatic ring in the PET repeating units gives the polymer notable stiffness and strength, especially when the polymer chains are aligned with one another in an orderly arrangement by drawing (stretching). The stiffness of PET fibers makes them highly resistant to deformation, a characteristic particularly suitable for airgun sound moderator acoustic baffles. PET has a low softening temperature, approximately 70° C., and a melting temperature of approximately 250° C., this it will quickly deteriorate in the presence of gunpowder combustion temperers and pressures.

Polyethylene terephthalate felt materials are commercially available, and particularly configured for sound absorption applications. In an illustrative embodiment of the present disclosure, Acoufelt™ AP12 acoustic panel, which is prepared from 100% polyester, its employed. See www.acoufelt.com for further information on the AP12 product. The AP12 polyester felt product is available in 0.47" thick sheets having a density of 0.49 pounds per square foot, employing substantially heterogeneous fiber sizes with good acoustic absorption properties, meeting the AS ISO 354-2006 NRC sound absorption standard.

Reference is directed to FIG. 1, which is a side view drawing of an airgun 2 with a detachable sound moderator 22 according to an illustrative embodiment of the present invention. The airgun 2 includes a receiver 6 with a breach 14 at the rear of a barrel 10 disposed within a frame extension 20, hereinafter referred as a "frame". The barrel 20 is supported on plural barrel bushings 12 within the frame 20. The receiver 6 is fitted with suitable grips 16, and has a compressed air cylinder 18, which also acts as a butt stock in this embodiment, attached to provide the requisite energy to discharge projectiles (not shown). A sound moderator 22, according to an illustrative embodiment of the present disclosure, threadably engages the muzzle end of the frame 20, or barrel 12, depending on the length of the barrel 12 within the frame 20. With this embodiment, the airgun 2 may be employed with, or without, the sound moderator 22 attached thereto. The engagement between the airgun 2 and the sound moderator 22 may be accomplished with threads, cams, lugs, clamps, adapters, or other attachment techniques known to those skilled in the airgun arts.

Figure 2:
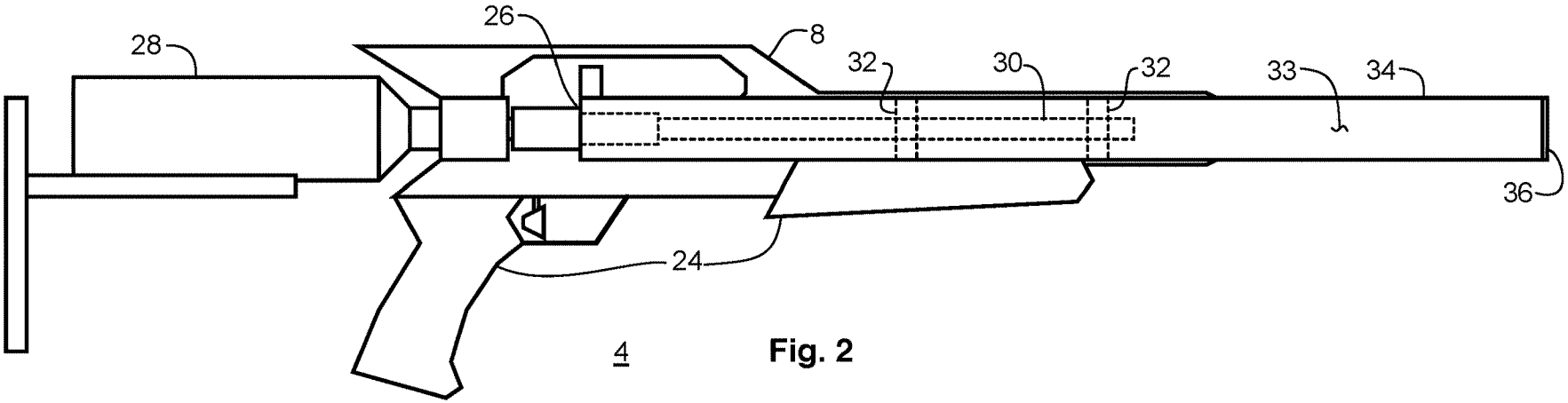
FIG. 2 is a side view drawing of an airgun with an integral sound moderator according to an illustrative embodiment of the present invention.

Reference is directed to FIG. 2, which is a side view drawing of an airgun 4 with an integral sound moderator 33 according to an illustrative embodiment of the present invention. The airgun 4 includes a receiver 8 with a breach 26 at the rear of a barrel 30, which is disposed within a frame extension 34, hereinafter referred as a "frame". The barrel 30 is supported on plural barrel bushings 32 within the frame 34. The receiver 8 is fitted with suitable grips 24, and has a compressed air cylinder 28, which also acts as a butt stock in this embodiment, attached to provide the requisite energy to discharge projectiles (not shown). A sound moderator assembly 33 (not shown in detail in this view), according to an illustrative embodiment of the present disclosure, is installed within the frame 34. The sound moderator assembly 33 is retained within the frame 34 by a muzzle cap 36, which is engaged with the muzzle end of the frame 34. Further details of this arrangement will be more fully described hereinafter.

Figure 3:
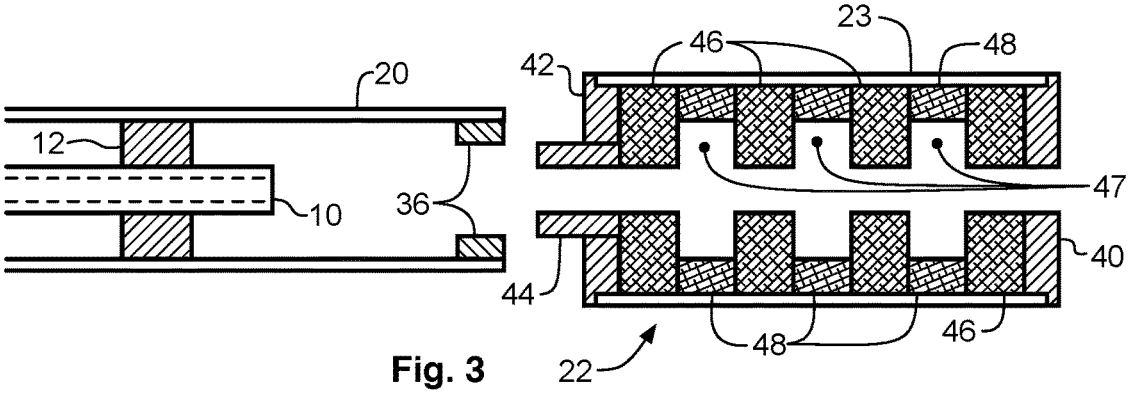
FIG. 3 is a section view drawing of an airgun muzzle and detachable sound moderator according to an illustrative embodiment of the present invention.

Reference is directed to FIG. 3, which is a section view drawing of an airgun muzzle portion and detachable sound moderator 22 according to an illustrative embodiment of the present invention. This embodiment corresponds with the embodiment of FIG. 1. In FIG. 3, the airgun's frame 20 is shown with the muzzle end of the barrel 10 that is supported by barrel bushing 12. And internally threaded moderator engagement fitting 36 is fixed to the muzzle end of the frame 20. The sound moderator 22 includes an elongated housing 23 having an airgun engagement fitting 42, 44 at a first end and a moderator muzzle cap 40 at a second end. The airgun engagement fitting comprises a housing adapter 42 and an airgun adapter 44, to enable the use of differing airgun engagement arrangements. In this embodiment, the airgun adapter 44 is externally threaded to engage the internally threaded moderator engagement fitting 36 that fixed to the muzzle end of the frame 20. Within the elongated housing is a stack of plural acoustic baffles 46, 48. In some embodiments, all of the acoustic baffles are identical. In this embodiments the internal diameters of the acoustic baffles vary and are interleaved, as illustrated. This arrangement provides chambers 47 within the baffle stack that assist in routing and dissipating the burst of air pressure that enters the sound moderator 22 upon discharge of the airgun.

Figure 4:
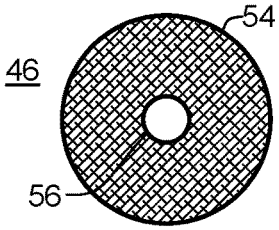
FIG. 4 is an end view drawing of an acoustic baffle according to an illustrative embodiment of the present invention.
Figure 5:
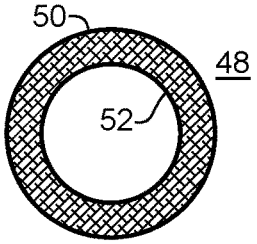
FIG. 5 is an end view drawing of an acoustic baffle according to an illustrative embodiment of the present invention.

Reference is directed to FIG. 4 and FIG. 5, which are end view drawings of the acoustic baffles 46, 48 according to an illustrative embodiment of the present invention. These drawings correspond with FIG. 3. FIG. 4 illustrates a fibrous polymeric felt acoustic baffle 46 that has an outer profile 54 shaped to substantially match the interior profile of the moderator elongated housing 23, and an internal diameter 56 that is sized to allow free passage of the airgun projectile (not shown) when the airgun is discharged. The specific diameter is not critical, but a diameter equal to twice the airgun caliber is a reasonable choice. FIG. 5 illustrates an alternate acoustic baffle 48 that is interleaved with the first baffle (see FIG. 4). This acoustic baffle 48 also has an outer profile 50 shaped to substantially match the interior profile of the moderator elongated housing 23, and an internal diameter 52 that is sized to define an internal chamber area 47 within the sound moderator 22 (see FIG. 3). Note that the internal diameters 56, 52 (FIG. 4, FIG. 5) are aligned such that the align along the bore axis the barrel 10 when the sound moderator 22 is attached (see FIG. 3).

Figure 6:
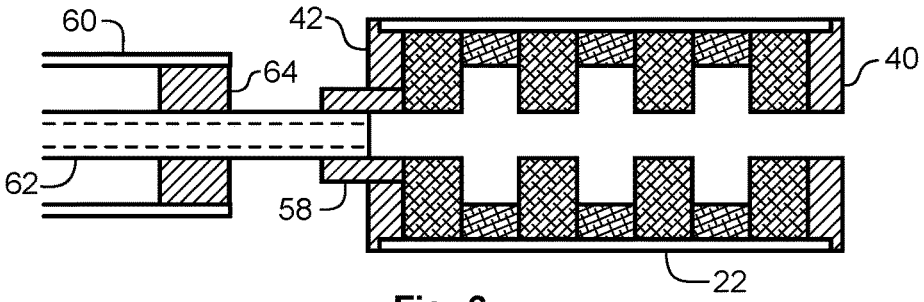
FIG. 6 is a section view drawing of an airgun muzzle and detachable sound moderator according to an illustrative embodiment of the present invention.

Reference is directed to FIG. 6, which is a section view drawing of an airgun muzzle and detachable sound moderator 22 according to an illustrative embodiment of the present invention. This embodiment differs from that of FIG. 3 in that this FIG. 6 moderator 22 has a difference airgun adaptor 58, which is internally threaded to engage the barrel 62 of the airgun directly, as illustrated. Otherwise, the airgun moderator 22 is the same as in FIG. 3. Note that in the embodiment of FIG. 6, the barrel 62 is supported from a barrel bushing 64 connected to the airgun frame 60, where the barrel 62 extends passed the frame 60.

Figure 7:
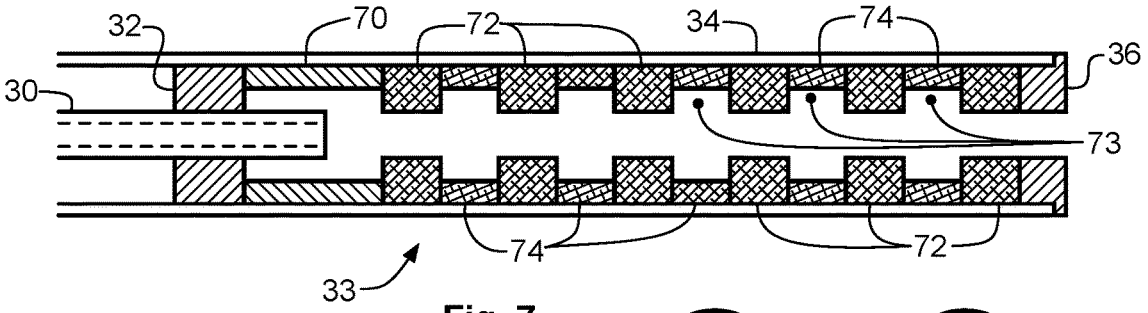
FIG. 7 is a partial section view drawing of an airgun with integral sound moderator according to an illustrative embodiment of the present invention.

Reference is directed to FIG. 7, which is a partial section view drawing of an airgun frame 34 with integral sound moderator 33 according to an illustrative embodiment of the present invention. This embodiment corresponds with the embodiment of FIG. 2. In FIG. 7, the airgun's frame 34 is shown with the barrel 30 that is supported by barrel bushing 32. A sound moderator assembly 33 is inserted into the frame 34, and enclosed by a muzzle cap 36. The sound moderator assembly 33 includes a baffle spacer 70 that holds a stack of fibrous polymeric felt acoustic baffles 72, 74 away from the muzzle end of the barrel 30. Within the airgun frame 34 is the stack of plural acoustic baffles 72, 74. In some embodiments, all of the acoustic baffles are identical. In this embodiments the internal diameters of the acoustic baffles vary and are interleaved, as illustrated. This arrangement provides chambers 73 within the baffle stack that assist in routing and dissipating the burst of air pressure that enters the sound moderator 33 upon discharge of the airgun. To assemble this embodiment, the muzzle cap 36 is removed from the frame, and then the baffle spacer 70 is inserted first. Next the plural acoustic baffles 72, 74 are inserted in the order illustrated, and are then enclosed by replacing the muzzle cap 36.

Figure 8:
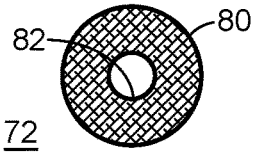
FIG. 8 is an end view drawing of an acoustic baffle according to an illustrative embodiment of the present invention.
Figure 9:
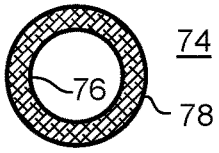
FIG. 9 is an end view drawing of an acoustic baffle according to an illustrative embodiment of the present invention.

Reference is directed to FIG. 8 and FIG. 9, which are end view drawings of the acoustic baffles 72, 74 according to an illustrative embodiment of the present invention. These drawings correspond with FIG. 7. FIG. 8 illustrates a fibrous polymeric felt acoustic baffle 72 that has an outer profile 80 shaped to substantially match the interior profile of the airgun frame 34 (see FIG. 7), and an internal diameter 82 that is sized to allow free passage of the airgun projectile (not shown) when the airgun is discharged. The specific diameter is not critical, but a diameter equal to twice the airgun caliber is a reasonable choice. FIG. 9 illustrates an alternate acoustic baffle 74 that is interleaved with the first baffle 72 (see FIG. 7). This acoustic baffle 74 also has an outer profile 78 shaped to substantially match the interior profile of the airgun frame 34 (see FIG. 7), and an internal diameter 76 that is sized to define an internal chamber area 73 within the sound moderator assembly 33. Note that the internal diameters 82, 76 (FIG. 8, FIG. 9) are aligned such that they align along the bore axis the barrel 30 when the sound moderator assembly 33 is inserted into the frame 34 (see FIG. 7).

Figure 10:
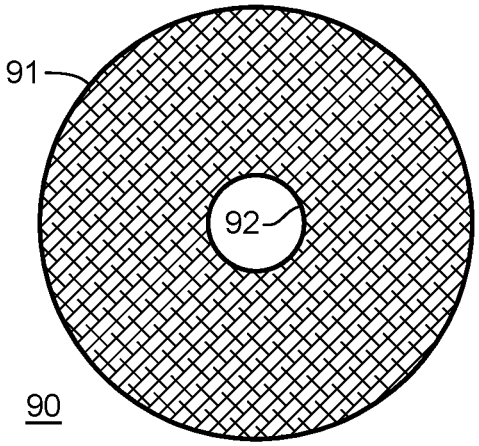
FIG. 10 is an end view drawing of an acoustic baffle according to an illustrative embodiment of the present invention.

Reference is directed to FIG. 10, which is an end view drawing of an acoustic baffle 90 according to an illustrative embodiment of the present invention. This baffle can be referred to as a "standard" baffle in that its outer profile 91 is size to substantially match the interior profile if the housing (not shown) into which it is inserted, and an interior profile 92 the is sized to clear the airgun projectile, as discussed hereinbefore. This interior profile 92 may be referred to as the bore space profile. It is fabricated from fibrous polymeric felt, which is laser cut, also as discussed hereinbefore. Note that the interior profile 92 will align with the bore axis of the host airgun (not shown).

Figure 11:
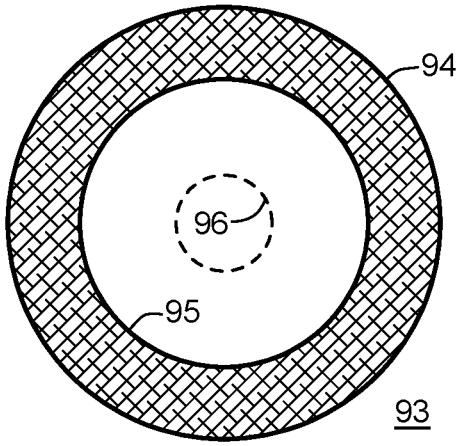
FIG. 11 is an end view drawing of an acoustic baffle according to an illustrative embodiment of the present invention.

Reference is directed to FIG. 11, which is an end view drawing of an acoustic baffle 93 according to an illustrative embodiment of the present invention. This baffle 93 can be referred to as a "open" baffle in that its outer profile 94 is size to substantially match the interior profile if the housing (not shown) into which it is inserted, but the interior profile 95 has an increased diameter over that of the projectile bore space 96. This size differentiation enables the creation of the aforementioned interior chambers that alter the acoustic signature of the sound moderator. The acoustic signature of the airgun is that of an impulse sound, which is comprised of an infinite series of higher-order harmonics according to Fourier analysis, which is beyond the scope of this disclosure. However, the acoustic performance of the sound moderator assembly can be subjectively determined, and the chamber shape altered to suit the desired characteristics of the designer. The following acoustic baffles shapes (FIGS. 12-15) share this design philosophy, and may be employed to achieve an improved acoustic signature.

Figure 12:
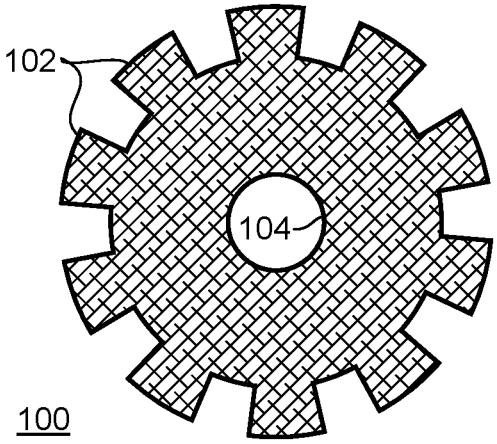
FIG. 12 is an end view drawing of an acoustic baffle with castellated outer edge according to an illustrative embodiment of the present invention.

Reference is directed to FIG. 12, which is an end view drawing of an acoustic baffle 100 with castellated outer edge 102 according to an illustrative embodiment of the present invention. The interior profile 104 is the projectile bore space, as illustrated with acoustic chambers defined by the castellation 102. The outer profile 102 is sized to substantial match that of the host enclosure, which thereby locates the projectile bore space 104 along the bore axis of the host airgun.

Figure 13:
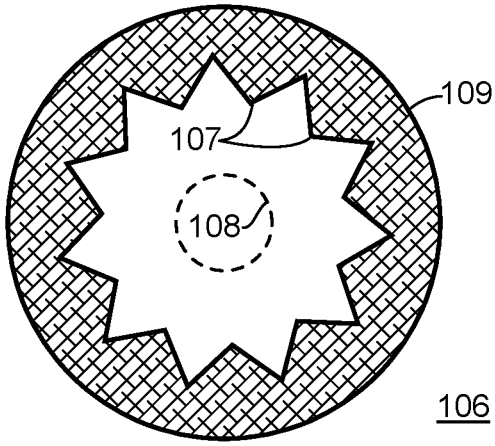
FIG. 13 is an end view drawing of an acoustic baffle with zigzag internal edge according to an illustrative embodiment of the present invention.

Reference is directed to FIG. 13, which is an end view drawing of an acoustic baffle 106 with zigzag internal edge profile 107 according to an illustrative embodiment of the present invention. The interior profile 107 is opened beyond that of the projectile bore space 108, thereby defining a complex acoustic chamber to control the acoustic signature of the assembly. The outer profile 109 is sized to substantial match that of the host enclosure.

Figure 14:
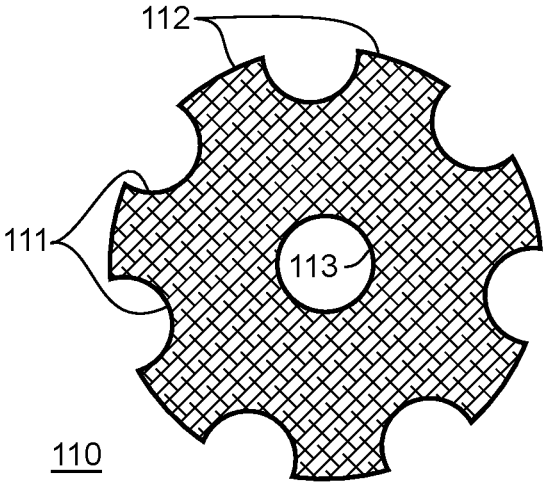
FIG. 14 is an end view drawing of an acoustic baffle with scalloped outer edge according to an illustrative embodiment of the present invention.

Reference is directed to FIG. 14, which is an end view drawing of an acoustic baffle with scalloped outer edge 111, 112 according to an illustrative embodiment of the present invention. The interior profile 113 is the projectile bore space, as illustrated, with acoustic chambers defined by the scallops 111. The outer profile 112 is sized to substantial match that of the host enclosure, which thereby locates the projectile bore space 113 along the bore axis of the host airgun.

Figure 15:
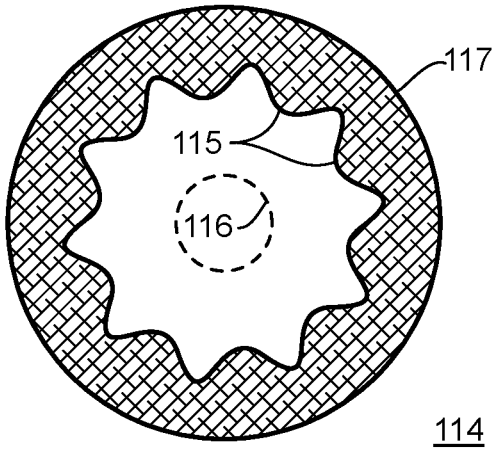
FIG. 15 is an end view drawing of an acoustic baffle with undulating internal edge according to an illustrative embodiment of the present invention.

Reference is directed to FIG. 15, which is an end view drawing of an acoustic baffle 114 with undulating internal edge profile 115 according to an illustrative embodiment of the present invention. The interior profile 115 is opened beyond that of the projectile bore space 116, thereby defining a complex acoustic chamber to control the acoustic signature of the assembly. The outer profile 117 is sized to substantial match that of the host enclosure.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An airgun sound moderator assembly for attachment to an airgun having a barrel that defines a bore axis, the barrel fixed to a frame member, and having a moderator engagement fitting adjacent a muzzle end thereof, comprising:

an elongated housing having an interior profile, and having an airgun engagement fitting at a first end, and having a moderator muzzle cap at a second end, and wherein said airgun engagement fitting is selectively attachable to the airgun moderator engagement fitting;

a stack of acoustic baffles comprised entirely of plural acoustic baffles located adjacent to one another, and within said elongated housing between said airgun engagement fitting and said moderator muzzle cap, and wherein said plural acoustic baffles are each fabricated from a fibrous polymer felt comprised of aromatic rings in polymeric chains that yield stiffness and resist deformation of said plural acoustic baffles so as to endure repeated compressed air pressure blasts, and which inherently defines a polymer softening temperature and a polymer melting temperature, both of which are below three hundred degrees Celsius, such that said plural acoustic baffles will rapidly deteriorate if exposed to gunpowder combustion products and temperatures, rendering the airgun sound moderator assembly unsuitable for use as a firearms silencer, and wherein each of said plural acoustic baffles are substantially planar, having a thickness in the range of 0.5 to 4.0 centimeters, with an outer profile that at least partially conforms with said interior profile of said elongated housing, and each having a bore hole formed therethrough, which is aligned with the bore axis when said airgun engagement fitting is engaged with the moderator engagement fitting.

2. The assembly of claim 1, and wherein:

said fibrous polymer felt is fabricated from polyethylene terephthalate fibers.

3. The assembly of claim 2, and wherein:

said polyethylene terephthalate fibers are substantially heterogeneous in size, and said plural acoustic baffles are thermally cut from sheet felt material, which fuses the cut edges to thereby enhance rigidity.

4. The assembly of claim 1, wherein the moderator engagement fitting is fixed to the airgun frame and internally threaded, and wherein:

said airgun engagement fitting is externally threaded for selective attachment to the moderator engagement fitting.

5. The assembly of claim 1, wherein the airguns discharges a projectile of predetermine caliber, and wherein:

said plural acoustic baffles comprise a first portion of baffles interleaved with a second portion of baffles, and wherein said first portion of baffles have round boreholes having a first diameter that is larger than said predetermined caliber, and said second portion of baffles have a second bore hole size that is greater than said first diameter.

6. The assembly of claim 5, and wherein:

said second bore hole size is cut to reveal a zigzag edge profile.

7. The assembly of claim 5, and wherein:

said second bore hole size is cut to reveal an undulating edge profile.

8. The assembly of claim 1, and wherein:

a portion of said plural acoustic baffles are cut such that said outer profile reveals a concave scalloped edge.

9. The assembly of claim 1, and wherein:

a portion of said plural acoustic baffles are cut such that said outer profile reveals a castellated edge.

10. An airgun sound moderator assembly for insertion into an airgun having a barrel that defines a bore axis, the barrel located within a frame member by a barrel support member, the frame member having an interior profile and enclosed at a muzzle end by a muzzle cap, comprising:

a stack of plural acoustic baffles, comprised entirely of plural acoustic baffles located adjacent one another, and locatable within the frame between the barrel support member and the muzzle cap, and wherein said plural acoustic baffles are each fabricated from a fibrous polymer felt comprised of aromatic rings in polymeric chains that yield stiffness and resist deformation of said plural acoustic baffles so as to endure repeated compressed air pressure blasts, and which inherently defines a polymer softening temperature and a polymer melting temperature, both of which are below three hundred degrees Celsius, such that said plural acoustic baffles will rapidly deteriorate if exposed to gunpowder combustion products and temperatures, rendering the airgun sound moderator assembly unsuitable for use as a firearms silencer, and wherein each of said plural acoustic baffles are substantially planar having a thickness in the range of 0.5 to 4.0 centimeters, with an outer profile that at least partially conforms with the interior profile of the frame member, and each having a bore hole formed therethrough, which is aligned with the bore axis when inserted into the airgun frame.

11. The assembly of claim 10, and further comprising:

a baffle spacer disposed between the barrel support member and said stack of plural acoustic baffles to thereby provide separation between the barrel and said stack of plural acoustic baffles.

12. The assembly of claim 10, and wherein:

said fibrous polymer felt is fabricated from polyethylene terephthalate fibers.

13. The assembly of claim 12, and wherein:

said polyethylene terephthalate fibers are substantially heterogeneous in size, and said plural acoustic baffles are thermally cut from sheet felt material, which fuses the cut edges to thereby enhance rigidity.

14. The assembly of claim 10, wherein the airguns discharges a projectile of predetermine caliber, and wherein:

said plural acoustic baffles comprise a first portion of baffles interleaved with a second portion of baffles, and wherein said first portion of baffles have round boreholes having a first diameter that is larger than said predetermined caliber, and said second portion of baffles have a second bore hole size that is greater than said first diameter.

15. The assembly of claim 14, and wherein:

said second bore hole size is cut to reveal a zigzag edge profile.

16. The assembly of claim 14, and wherein:

said second bore hole size is cut to reveal an undulating edge profile.

17. The assembly of claim 10, and wherein:

a portion of said plural acoustic baffles are cut such that said outer profile reveals a concave scalloped edge.

18. The assembly of claim 10, and wherein:

a portion of said plural acoustic baffles are cut such that said outer profile reveals a castellated edge.

19. A method of fabricating an airgun moderator assembly, including a stack of plural acoustic baffles comprised entirely of the plural acoustic baffles located adjacent one another, which are for insertion into an airgun having a barrel fixed to a frame member that defines a bore axis, and having a moderator engagement fitting adjacent a muzzle end thereof for attachment of an elongated housing having an interior profile, and having an airgun engagement fitting at a first end, and having a moderator muzzle cap at a second end, and wherein said airgun engagement fitting is selectively attachable to the airgun moderator engagement fitting, or for insertion of the plural acoustic baffles into an airgun having a barrel located within a frame member by a barrel support member, the frame member having an interior profile and enclosed at a muzzle end by a muzzle cap, thereby enabling location of the stack of plural acoustic baffles within the frame member between the barrel support member and the muzzle cap, the method comprising the steps of:

selecting a substantially planar sheet of fibrous polymer felt comprised of aromatic rings in polymeric chains that yield stiffness and resist deformation so as to endure repeated compressed air pressure blasts, and within the thickness range of 0.5 to 4.0 centimeters according to its inherent polymer softening temperate and polymer melting temperature, which are both less then three hundred degrees celsius, such that the polymer will rapidly deteriorate if exposed to gunpowder combustion products and temperatures, and according to the fibrous polymer felt rigidity, thereby providing structural rigidity below the polymer softening temperature, and rendering the airgun sound moderator unsuitable for use as a firearms silencer;

cutting the plural acoustic baffles from the sheet of fibrous polymer felt, wherein each of the plural acoustic baffles have an outer profile that at least partially conforms with the interior profile of the elongated housing or the interior profile of the frame member, and each having a bore hole formed therethrough, which is located to align with the bore axis of the airgun, thereby moderating the acoustic impulse emitted by the airgun upon discharge of a projectile.

20. The method of claim 19, and wherein:

the fibrous polymer felt is fabricated from polyethylene terephthalate fibers.

21. The method of claim 20, and wherein the polyethylene terephthalate fibers are substantially heterogeneous in size, and further comprising the step of:

thermally cutting the plural acoustic baffles from sheet of polymer felt, thereby fusing the cut edges and enhancing rigidity.

22. The method of claim 19, wherein the airgun discharges a projectile of predetermine caliber, and wherein:

said cutting step further includes cutting a first portion of the plural acoustic baffles and cutting a second portion of the plural acoustic baffles;

interleaving the first portion and second portion of the plural acoustic baffles, and wherein the first portion of baffles are cut with round boreholes having a first diameter that is larger than the predetermined caliber, and the second portion of baffles are cut with a second bore hole size that is greater than the first diameter.

* * * * *